United States Patent [19]

Bassett, Jr. et al.

[11] 4,024,624

[45] May 24, 1977

[54] CONTINUOUS CASTING METHOD FOR THE PRODUCTION OF ROLLED LOW CARBON STEEL PRODUCTS WITH IMPROVED FORMABILITY

[75] Inventors: James G. Bassett, Jr., Franklin Township, Westmoreland County; Saul Gilbert, Pittsburgh, both of Pa.

[73] Assignee: United States Steel Corporation, Pittsburgh, Pa.

[22] Filed: Mar. 31, 1976

[21] Appl. No.: 672,099

[52] U.S. Cl. ..... 29/527.7; 164/57

[51] Int. Cl.[2] ..... B22D 27/20

[58] Field of Search ..... 29/527.7; 164/55, 57

[56] References Cited

UNITED STATES PATENTS

| | | | |
|---|---|---|---|
| 3,367,395 | 2/1968 | Karsay | 164/57 |
| 3,819,365 | 6/1974 | McCaulay et al. | 164/55 |
| 3,850,624 | 11/1974 | Hulit et al. | 164/57 X |
| 3,911,993 | 10/1975 | Caudill et al. | 164/55 |
| R27,447 | 8/1972 | Richards | 29/527.7 |

*Primary Examiner*—Milton S. Mehr
*Attorney, Agent, or Firm*—Arthur J. Greif

[57] ABSTRACT

The relatively poor formability and spot weld fracture appearance of hot-rolled and heavy gauge cold-rolled low carbon steels (in which silicon is the primary deoxidant) have been attributed to manganese silicate stringer-type inclusions, generally found in this product. The addition of at least about 1/8 pound magnesium, per ton of steel cast, is shown to modify this deleterious inclusion morphology, with a resultant improvement in the ductility and weldability of such hot-rolled and the heavy gauge cold-rolled products.

4 Claims, No Drawings

CONTINUOUS CASTING METHOD FOR THE PRODUCTION OF ROLLED LOW CARBON STEEL PRODUCTS WITH IMPROVED FORMABILITY

This invention relates to the continuous casting of low carbon steels and is particularly related to a method for modifying the morphology of the silicate inclusions in such steels so as to improve the formability and weldability of thick sheet product, i.e. hot-rolled and heavy gauge (generally > 0.05 inches thick) cold-rolled sheet product.

Cold rolled sheet, produced from continuously cast low carbon strands has gained wide customer acceptance. In general, such sheet produced by processes such as shown in U.S. Pat. No. Re 27,447 has exhibited formability equal or superior to that of ingot cast rimmed steels. Unofortunately, it was found that in view of certain characteristics of these steels associated with the morphology of silicate, stringer-type inclusions, that these steels were not desirable for many hot-rolled sheet and heavy gauge cold-rolled and galvanized sheet applications, especially those applications which require difficult forming applications. With respect to light gauge cold-rolled sheet it was found that these inclusions have essentially no deleterious effect on forming properties, since the cold reduction fragments and disperses the inclusions. However, during hot rolling or during relatively slight cold reduction these stringer-type inclusions are not extensively fragmented and dispersed. One solution to this problem is shown in U.S. Pat. No. 3,459,537 in which the oxygen content, and thus the inclusion content, is significantly reduced by vacuum treatment. Although this method is capable of producing strand cast slabs with improved formability for heavier gauge sheet applications, this process is costly as a result of (*a*) increased capital costs associated with the installation of vacuum degassing equipment and (*b*) increased operating costs.

It is therefore a principle object of the instant invention to provide an economical method for the production of continuously cast low carbon steel sheet with improved formability when processed to comparatively thick sheet.

This and other objects and advantages of the instant invention will become more apparent from a reading of the following description when taken in conjunction with the appended claims.

The deoxidation procedures which are employed in the continuous casting of low carbon steel may be divided into two main categories — (*a*) in which silicon is a principle deoxidant and (*b*) in which aluminum is the principle deoxidant. The successful strand casting of aluminum killed steels generally requires the use of immersed nozzles and mold fluxes which add both to operating difficulty and the cost of continuous casting. Primarily, as a result of its economic advantage, the former deoxidation method utilizing silicon (e.g., U.S. Pat. No. Re 27,447) is extensively employed for the production of sheet steel suitable for such applications as: enameling sheet, electrical sheet, and tin plate and TFS sheet for container applications, as well as other areas where conventionally-cast rimmed-type steels have been employed. The deoxidation products retained as inclusions in such Si deoxidized steels have been analyzed as complex manganese-silicates or manganese-aluminum-silicates. These inclusions are plastic at hot rolling temperatures and therefore tend to occur as continuous stringers in hot rolled sheet product. This is to be contrasted with the typical manganese-iron-oxide inclusions in rimmed and capped steels and the alumina inclusions in aluminum killed steel which are not plastic at hot rolling temperatures, and therefore do not significantly deform during hot working. Because of the continuous stringer morphology of the manganese silicate inclusions in continuously cast thick sheet product, this product has exhibited limited formability and tends to exhibit laminar tearing in fracture tested spot welds. An experimental program was therefore conducted to determine if more favorable inclusion morphology could be attained by the addition of various elements to continuously cast low carbon steel. Initial screening as to the effect of such addition elements on stringer morphology, was conducted utilizing laboratory size, conventionally cast ingots. The first series of tests utilized varying concentrations of each of the elements (or mixtures thereof) listed in Table I, below.

Table I

| | Addition | Concentrations Added Min. (%) | Max (%) |
|---|---|---|---|
| 1 | B | 0.004 | 0.008 |
| 2 | Ti | 0.01 | 0.03 |
| 3 | Cb | 0.005 | 0.01 |
| 4 | V | 0.01 | 0.03 |
| 5 | V + Ti | 0.005(V)<br>0.005(Ti) | 0.01(V)<br>0.01(Ti) |
| 6 | Ti + B | 0.01(Ti)<br>0.004(B) | 0.01(Ti)<br>0.008(B) |

The second series of tests utilized addition alloys containing: Ca-Mn-Al; Ca-Al; Ca-Al-Ba; Mn-Si and Mn-Al, again in varying proportions. All of the above noted addition agents (both series of tests) proved ineffective in modifying stringer morphology to an extent sufficient to materially improve formability.

Although the use of other elements, including that of alkaline earth metals such as calcium proved to be ineffective, it was nevertheless found that additions of Mg could substantially alter the deleterious inclusion morphology of manganese silicate stringers, so as to produce a sheet product with comparatively good formability in the hot-rolled or heavy gage cold-rolled condition. The experimentation and the results of this latter work are more extensively discussed hereinafter.

Four 300-pound heats were cast into a water-cooled 3¼ by 3¼ by 18-inch long copper mold to produce a cast bar about 8 feet long. A crushed 15 percent magnesium — 85 percent nickel alloy, contained in a thin steel sheath, was added to the metal in the mold during casting. The nickel-magnesium alloy was used rather than elemental magnesium because it has a density close to that of liquid steel and because the activity of the magnesium-nickel alloy is lower than that of pure magnesium in liquid steel and less likely to cause fuming. The approximate overall chemical composition of the wire, including the steel sheath, was 65 percent iron, 5 percent magnesium and 30 percent nickel. The wire was added at varying rates of one, two and three inches per second during the continuous casting of these steels. The casting rate for all the heats was 50 inches per minute. Since the wire, (sheath plus Ni-Mg alloy) weighed 1.32 grams per inch, the wire feed rates of 1, 2 and 3 inches per second resulted in magnesium additions of about ⅛, ¼ and ⅜ pound per ton of steel cast. A 1-foot section of the cast bar was cut from the midlength of each cast and was hot-rolled to ½-inch-thick plate. Sections of the ½-inch plates were reheated to 2300° F and hot-rolled in three passes to 0.090-inch-thick sheet, finished at 1600° F and coiled at 1175° F to simulate conventional hot-strip mill procedures.

Samples of the 0.090-inch-thick hot-rolled sheets were obtained for chemical analysis, metallographic examination including inclusion-content measurements on the quantitative television microscope (QTM), inclusion analysis on the scanning electron microscope (SEM), Charpy V-Notch impact tests, and Kaiser Wilhelm Institute (KWI) hole-expansion tests. The compositions of the four heats used in this evaluation are shown in Table II. The addition of ⅛ pound of magnesium per ton of steel represents only 62.5 ppm magnesium in the steel. This increase in the magnesium concentration was not observed in chemical analysis of the steel. Apparently, much of the magnesium was lost (as vapor) during casting of the steel. However, the increase in the nickel content of the steels with increasing feed rate of the Ni-Mg alloy agrees with the addition of nickel contained in the alloy and is indicative of the quantity of the alloy that was added to the steels.

TABLE II

Magnesium Additions

Chemical Composition of Steels Evaluated

| Cast No. | Ni-Mg Wire Additions, in./sec | Composition, percent C | Mn | P | S | Si | Ni | Mg | Al Sol | Al Total | N | O, ppm |
|---|---|---|---|---|---|---|---|---|---|---|---|---|
| 1171 | 0 (0*) | 0.043 | 0.37 | 0.010 | 0.015 | 0.045 | 0.06 | <0.0003 | 0.001 | <0.002 | 0.010 | 535 |
| 1149 | 1(⅛) | 0.050 | 0.36 | 0.010 | 0.016 | 0.060 | 0.10 | <0.0003 | <0.001 | <0.002 | 0.010 | 393 |
| 1172 | 2(¼) | 0.052 | 0.36 | 0.010 | 0.016 | 0.048 | 0.13 | 0.0060 | <0.001 | <0.002 | 0.009 | 336 |
| 1148 | 3(⅜) | 0.054 | 0.36 | 0.011 | 0.017 | 0.060 | 0.18 | 0.0086 | 0.001 | <0.002 | 0.010 | 387 |

*Values in parentheses are corresponding equivalent magnesium additions in pounds of magnesium per ton of steel.

Microcleanliness

The results of QTM cleanliness ratings, Table III, show that all four parameters of cleanliness — area, worst field, number of fields with ≥ 0.5 percent volume fraction of inclusions, and length factor — generally improved with increasing additions of nickel-magnesium. The optimum addition for these specific conditions appeared to be about ¼ pound of magnesium per ton.

TABLE III

QTM Results for Nickel-Magnesium Treated Steels of Table II

| Cast No. | Mg Mold Additions, lb/ton | Inclusion Area, % | Worst-Field Area, % | No. of Fields ≥ 0.5% | Length Factor (100 Fields)* |
|---|---|---|---|---|---|
| 1171 | 0 | 0.78 | 36.00 | 7.8 | 44.2 |
| 1149 | ⅛ | 0.24 | 6.20 | 2.5 | 14.3 |
| 1172 | ¼ | 0.14 | 0.63 | 0.8 | 0.5 |
| 1148 | ⅜ | 0.17 | 0.88 | 1.5 | 0.5 |

$$\text{*Length Factor (100 Fields)} = 2\left(\frac{\text{Sum of Length of All Inclusions Longer Than 125 Microns}}{125\ \text{Microns}}\right)$$

Morphology

As shown in Table IV, the silicate-type inclusions in the samples containing no magnesium were generally typical of those normally found in these steels: namely, elongated, glassy manganese silicates and manganese-aluminum silicates. At ⅛ pound of magnesium per ton, many of the silicate inclusions contained magnesium and had become globular. The morphology of the manganese silicates without detectable magnesium appears also to have changed in some cases, becoming less continuous. Since the detectable limit for magnesium oxide with the SEM in these inclusions is about 1 to 2 percent, it is possible that the change in morphology was caused by the presence of magnesium below the level of detection with the SEM.

TABLE IV

Morphology and Composition of the Inclusions Found in Hot-Rolled Sheets of Nickel-Magnesium Treated Steels

| Cast No. | Mg Mold Addition, lb/ton | Silicate Inclusion Analyzed | Silicate Inclusion Morphology* Shape | Dispersion | Elements Found in Silicate Inclusions (SEM analysis) |
|---|---|---|---|---|---|
| 1171 | None | 1. | S | C | Mn-Si |
| | | 2. | S | C | Mn-Si-Al |
| | | 3. | S | C | Mn-Si-S |
| | | 4. | S | C | Mn-Si-S-Al |
| | | 5. | S | B | Mn-Si-S |
| | | 6. | S | D | Mn-Si-Al-S |
| 1149 | ⅛ | 1. | G | D | Si-Mn-Mg-S-Al |
| | | 2. | S | C | Mn-Si-Mg |
| | | 3. | G | D | Mn-Si-Al-Mg-S |
| | | 4. | S | B | Mn-Si |
| | | 5. | S | B | Mn-Si-S-Al |
| | | 6. | G | D | Mn-SI-Mg |
| 1172 | ¼ | 1. | S | B | Mn-Si-S |
| | | 2. | G | B | Si-Mn-Mg |
| | | 3. | G | D | Si-Mn-Mg-Al |
| | | 4. | S | B | Mn-Si |
| | | 5. | G | D | Mn-Si-Mg |
| 1148 | ⅜ | 1. | G | B | Mn-Si-Al-Mg |
| | | 2. | G | D | Mn-Si-Mg |
| | | 3. | G | D | Si-Mn-Mg |

TABLE IV-continued

Morphology and Composition of the Inclusions Found in Hot-Rolled Sheets of Nickel-Magnesium Treated Steels

| Cast No. | Mg Mold Addition, lb/ton | Silicate Inclusion Analyzed | Silicate Inclusion Morphology* Shape | Dispersion | Elements Found in Silicate Inclusions (SEM analysis) |
|---|---|---|---|---|---|
| | | 4. | G | B | Si-Mn-Mg |

*Inclusion (morphology) code: Shape – S = stringer; G = globular. Dispersons – C = continuous, aligned; B = broken, aligned; D = dispersed, nonaligned.

In the steel treated with ¼ pound of magnesium per ton, most of the inclusions were of the manganese-magnesium silicate (globular) type, with a few broken manganese silicate stringers also present. In the steel containing ⅜ pound of magnesium per ton, all the silicate inclusions contained at least a detectable amount of magnesium oxide, and essentially all the inclusions were of the globular or angular type, although many were aligned as discontinuous stringers.

Mechanical Properties

The Rockwell B hardness of the hot-rolled sheet, Table V, ranged from 61.1 to 65.2 and appeared to be unaffected by the nickel-magnesium additions. These hardness values fall within the typical range for hot-rolled steels of this type. The transverse Charpy V-notch impact-energy absorption at 80° F (shelf energy) is known to increase (improve) with improved cleanliness (amount, size, shape, or distribution of nonmetallic inclusions). In these samples, the shelf energy increased with increasing additions of Mg, indicating an effective improvement in the microcleanliness.

KWI Hole-Expansion Tests

The results of KWI hole-expansion tests on samples with 0.656-inch-diameter (16.7 mm) machined holes are also given in Table V. In tests of this type, the formed depth at fracture is known to be particularly related to the presence (or absence) of stringer inclusions.

TABLE V

Hardness, Charpy V-Notch Shelf Energy, and KWI Depth-to-Fracture Results of Hot-Rolled Sheet

| Cast No. | Mg Mold Addition, lb/ton | Hardness, $R_B$ | Average Transverse CVN Impact Energy Absorption at 80 F, ft-lb | KWI* Hole Expansion Test: Average Depth to Fracture, inch | KWI* Hole Expansion Test: Circumferential Strains, % |
|---|---|---|---|---|---|
| 1171 | 0 | 62.7 | 7.3 | 0.642 | 86.4 |
| 1149 | ⅛ | 62.7 | 11.3 | 0.648 | 94.3 |
| 1172 | ¼ | 65.2 | 12.3 | 0.724 | 107.2 |
| 1148 | ⅜ | 61.1 | 16 | 0.717 | 107.1 |

*Kaiser Wilhelm Institute hole expansion test using 0.656-inch drilled hole.

The benefits of the instant invention may therefore be attained, utilizing the following procedure. In conventional manner, the steel melt is adjusted to a composition consisting essentially of, in weight percent, 0.01 – 0.15 C, 0.2 – 0.6 Mn, 0.01 – 0.10 Si and 0.015 max. Al; preferably the maximum C will be 0.08 and the Si will be within the range 0.03 – 0.08. The so adjusted melt is poured into the tundish and thereafter teemed into the continuous casting mold wherein a jacketed Mg wire is fed into the metal within the mold, at a rate of ⅛ to ½ lbs. per ton of steel cast, preferably ¼ to ⅜ lbs. per ton, at a point contiguous to the line of contact of the metal stream with the surface of the metal pool within the mold. It should be understood, however, that modification of stringer morphology is dependent on the amount of Mg which is recovered in the cast strand and not on the point of Mg addition. Thus, it would be possible, but generally not practical, to achieve the desired morphology modification by adding Mg to the molten metal in the tundish or even to that in ladle. However, the latter procedure would be materially costlier, since the recovery of Mg would be significantly decreased (greater amounts vaporized and/or oxidized). Additional costs would be incurred, since the use of special procedures (e.g. argon purged nozzle) would generally be required to avoid nozzle blockage. Similar problems, although less severe, may occur if the Mg were to be added to the metal in the tundish. In view of the decreased recovery, it may be necessary to add as much as 1 lb. of Mg per ton of steel in the tundish.

We claim:

1. In the manufacture of thick steel sheet product consisting essentially of, in weight percent, 0.01 to 0.15% C, 0.2 to 0.6% Mn, 0.01 to 0.10% Si and 0.015% max. Al, said product being produced by the continuous casting of a steel melt to produce a cast strand, thereafter rolling said strand only to the extent required to produce said thick sheet product, said product containing an undesirable degree of stringer-type inclusions resulting in poor formability, the improvement for modifying the inclusion morphology and enhancing the formability thereof, which comprises introducing Mg into said melt, in an amount of ⅛ to 1 lb. per ton of steel, said amount being effective to significantly reduce both the total inclusion area, and the percentage of continuous, aligned stringer-type inclusions present.

2. The method of claim 1, wherein said melt is poured into a continuous casting mold, and said Mg is introduced into said mold in an amount of ⅛ to ¼ lb. per ton of steel.

3. The method of claim 2, wherein said Mg is added in the form of a Mg-Ni alloy containing less than 0.3 parts Mg.

4. The method of claim 3, wherein said product has a C content of 0.08% max., the Si is within the range 0.03 to 0.08% and the amount of Mg added is at least about ¼ lb. per ton.

* * * * *

UNITED STATES PATENT OFFICE

CERTIFICATE OF CORRECTION

Patent No. 4,024,624 Dated May 24, 1977

Inventor(s) James G. Bassett, Jr. and Saul Gilbert

It is certified that error appears in the above-identified patent and that said Letters Patent are hereby corrected as shown below:

Column 3, line 39, "cleanliness — area," should be -- cleanliness — inclusion area, --;

Column 4, Table IV, in Cast No. 1149, Silicate Inclusion Analyzed 6., under column entitled "Elements Found in Silicate Inclusions (SEM analysis)", "Mn-SI-Mg" should read -- Mn-Si-Mg --;

Claim 2, "amount of 1/8 to 1/4 lb. per ton" should be -- amount of 1/8 to 1/2 lb. per ton --;

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*